United States Patent [19]

Saulgeot

[11] 4,332,522

[45] Jun. 1, 1982

[54] HARD VACUUM PUMP

[75] Inventor: Claude Saulgeot, Veyrier du Lac, France

[73] Assignee: Societe Anonyme dite Compagnie Industrielle des Telecommunications Cit-Alcatel, Paris, France

[21] Appl. No.: 114,141

[22] Filed: Jan. 21, 1980

[30] Foreign Application Priority Data

Jan. 19, 1979 [FR] France ..... 79 01317

[51] Int. Cl.[3] ..... F01D 1/36

[52] U.S. Cl. ..... 415/90; 415/170 R

[58] Field of Search ..... 415/90, 169 A, 170 R, 415/170 B, 173 A

[56] References Cited

U.S. PATENT DOCUMENTS 3,131,942 5/1964 Ertaud ..... 415/169 A
3,189,264 6/1965 Becker ..... 415/90

FOREIGN PATENT DOCUMENTS 2263612 7/1974 Fed. Rep. of Germany ..... 415/90
542024 2/1977 U.S.S.R. ..... 415/90

*Primary Examiner*—Louis J. Casaregola
*Attorney, Agent, or Firm*—Sughrue, Mion, Zinn, Macpeak and Seas

[57] ABSTRACT

The invention relates to a high-speed hard vacuum rotary pump. A hard vacuum rotary pump which includes a rotor (2) driven by a motor (20) disposed on the outside of the pump body and connected to the motor by a drive shaft (1) which is sealed by a grooved dynamic seal (8) is characterized in that said shaft is supported firstly by an outer bearing (6) disposed on the outside of the pump body (4) and secondly by an inner bearing (5) disposed inside the pump body and lubricated with grease. The invention applies in particular to molecular and turbomolecular vacuum pumps.

3 Claims, 2 Drawing Figures

HARD VACUUM PUMP

FIELD OF THE INVENTION

The invention relates to a high-speed hard vacuum rotary pump such as a molecular vacuum pump or a turbomolecular vacuum pump.

BACKGROUND OF THE INVENTION

Hard vacuum rotary pumps which operate on the molecular principle include a rotor which rotates at high speed in a stationary stator. The molecule transport effect is generated at the periphery of the rotor which rotates at high speed by reflection of a large proportion of these molecules from the facing zone of the stator; the stator then returns a large proportion of the molecules received to the part of the rotor which is situated below and so on, so that the rotor and stator assembly generates a pressure ratio between the partial pressure of the gas on the discharge side and the pressure of the same gas on the suction side.

The need for a high rotation speed of the rotor sets a serious problem for its bearings which must be installed in the vacuum. It is known to use ball bearings which operate in a primary vacuum and a drive motor also installed in a vacuum. But with such a type of pump, the difficulty lies in properly lubricating, especially cooling the balls, the cage and the races of the bearing, while cooling is impaired by heating which is inherent to the electric motor used.

The present invention aims to remedy these drawbacks.

SUMMARY OF THE INVENTION

The invention provides a hard vacuum rotary pump which includes a rotor driven by a motor disposed on the outside of the pump body and connected to the motor by a drive shaft which is sealed by a grooved dynamic seal, said pump being characterized in that said shaft is supported firstly by an outer bearing disposed on the outside of the pump body and secondly by an inner bearing disposed inside the pump body and lubricated with grease.

Preferably the inner bearing is disposed between the grooved dynamic molecular seal and a dynamic viscous seal interposed between the inner bearing and the outer bearing.

Preferably a longitudinal groove makes the two surfaces of the inner bearing communicate together.

The problem of efficient cooling of the ball bearings and of the drive motor is thus solved. The ball bearings which are situated in the vacuum zone are very easily cooled by conduction via the shaft, one of whose ends is easily cooled since it is in contact with the atmosphere; further, it can be lubricated with grease.

Likewise, the rotor and the stator of the motor are cooled by conventional means since these two parts are in contact with the atmosphere.

Further, the grooved dynamic seal has the advantages: of being friction free and therefore it does not wear; of being clean, since it requires no connection component; and of allowing discharge at atmospheric pressure without primary pumping.

The characteristics and advantages of the invention become apparent from the description of embodiments given by way of example and illustrated in the accompanying drawings.

DESCRIPTION OF PREFERRED EMBODIMENTS

Figure 1:
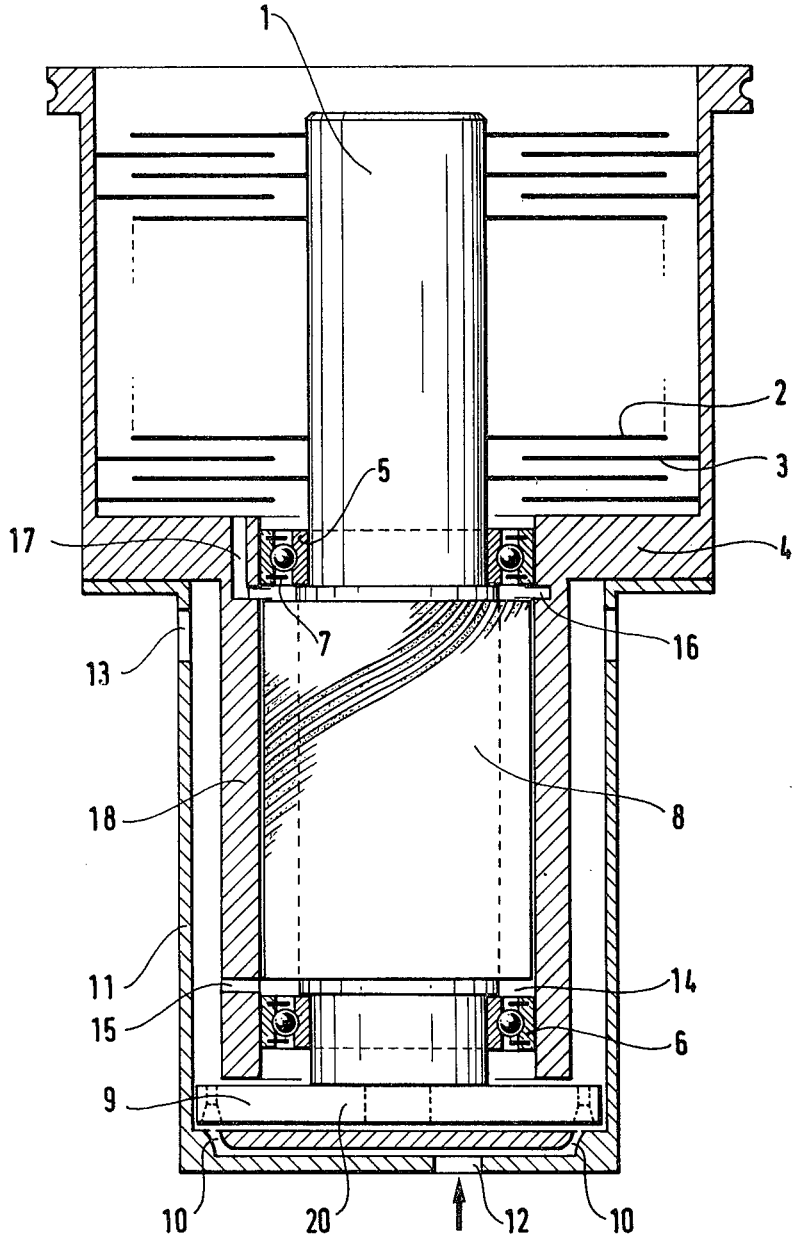
FIG. 1 is a schematic vertical cross-section of a turbomolecular pump in accordance with the invention.

In FIG. 1, the pumping assembly includes, as known, a pump body 4 which contains a multi-stage stator 3, said stator co-operating with a multi-stage rotor 2 installed on a drive shaft 1. The upper part of the pump body 4 is open to allow the pump to be connected to an installation, not shown, in which a hard vacuum is to be set up. The lower part of the body 4 has a constriction which constitutes a sleeve 18 whose end is open on the outside, i.e. communicates with the outside atmosphere. The drive shaft 1 passes through the sleeve 18 and is driven at its free end by a motor 20 which is constituted by a compressed air turbine rotor 9. The turbine is fed by injectors 10 incorporated in a hood 11 which fits over the sleeve. The hood 11 includes a compressed air inlet orifice 12 for the injectors 10 and air outlet orifices such as 13.

A grooved dynamic molecular seal 8 analogous to those described in published French patent application Nos. 1,293,546 and 2,161,180 prevents fluid from passing through the sleeve 18 of the pump body 4 and along the shaft 1.

The shaft 1 is supported firstly by an outer bearing 6 disposed on the outside between the lower part of the dynamic seal 8 and the drive motor 20 and secondly by an inner bearing 5 disposed at the upper part of the dynamic seal 8 and in direct communication with the vacuum pressure prevailing inside the pump body 4. The bearing 5 is then lubricated with grease and it is protected against the migration of the grease by protectors 7.

A longitudinal communication groove 17 and a circular groove 16 which is disposed between the bearing 5 and the dynamic seal 8 provide a passage for the gases which are found between the pump body 4 and the seal 8 bypassing the inner bearing 5. After passing through the grooved dynamic seal 8, the pumped gases are driven out through a circular groove 14 disposed between the dynamic seal 8 and the outer bearing 6 and through an orifice 15 of the sleeve 18 which communicates with the atmosphere.

Before leaving, the expanded and cooled air from the turbine flows over the outside of the sleeve 18 and therefore efficiently cools the ball bearings via the outer ball races. Likewise, the lower end of the dynamic seal 8 in contact with the atmosphere cools the inner ball race of the inner bearing by conduction, this allowing lubrication thereof with grease.

Figure 2:
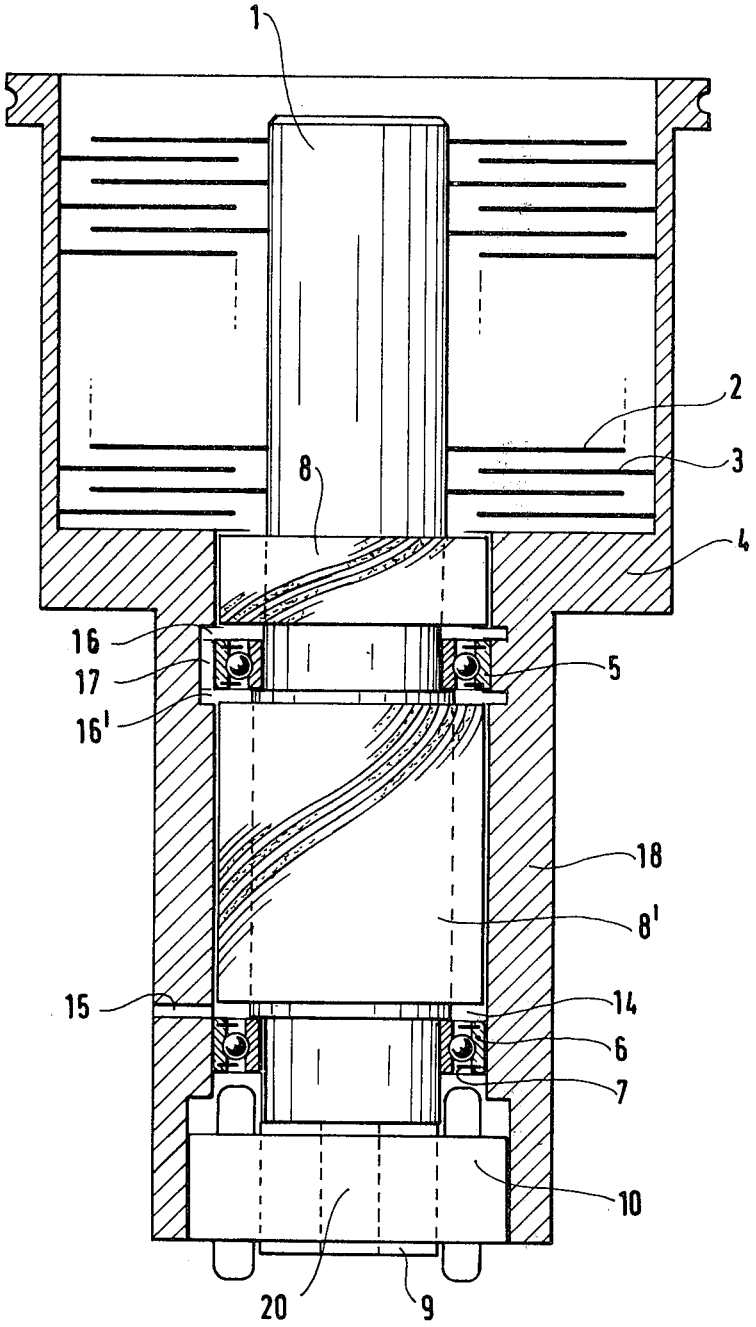
FIG. 2 is a schematic vertical cross-section of a variant of a turbo-molecular pump in accordance with the invention.

In the variant of FIG. 2, the drive motor 20 is an electric motor disposed at the end of the shaft and including a stator 10 and a rotor 9 and the sleeve 18 has no hood.

The inner bearing 5 is disposed between the grooved dynamic molecular seal 8 and a dynamic viscous seal 8'. The dynamic seal 8 is disposed directly adjacent the pump body 4, while the dynamic seal 8' which is analogous to that described in published French patent application No. 2,161,180 is disposed adjacent the outer bearing 6.

After passing through the grooved dynamic molecular seal 8, the pumped and discharged gases communicate with the periphery of the dynamic viscous seal 8' without passing through the inner bearing 5. The gases flow via a first circular groove 16 interposed between the bearing and the dynamic seals 8, via a longitudinal groove 17 and via a second circular groove 16'.

In the present case, the inner bearing 5 is located in a zone where the pressure is in the order of 1 to 10 torr, this being even more favourable.

It is obvious that the invention is in no way limited to the embodiment which has just been described and illustrated and which has been given only by way of example; in particular, without going beyond the scope of the invention, some dispositions can be modified or some means can be replaced by equivalent means or, even, some components can be replaced by others which are capable of performing the same technical function or an equivalent technical function.

I claim:

1. A hard vacuum rotary pump, said pump including a cylindrical pump body, said pump body including a cylindrical sleeve extending from one end thereof and coaxial therewith, a shaft rotatably mounted within said sleeve and including a portion extending axially beyond said sleeve within said pump body, a vacuum pump rotor (2) mounted to said shaft interiorly of said pump body, a motor (20) disposed on the outside of said pump body and connected to the pump rotor by said shaft, a grooved dynamic molecular seal (8) within said sleeve for sealing said shaft, the improvement wherein said shaft is supported firstly by an outer bearing (6) disposed on the outside of said pump body (4) within said sleeve, and at one end of said grooved dynamic molecular seal and secondly by an inner bearing (5) disposed inside the pump body (4) at the opposite end of said grooved dynamic molecular seal and in direct communication with the vacuum pressure prevailing inside said pump body and being lubricated with grease.

2. A pump according to claim 1, wherein said inner bearing (5) is disposed between the grooved dynamic molecular seal (8) and a further dynamic viscous seal (8') interposed between the inner bearing (5) and the outer bearing (6).

3. A pump according to claim 1 or 2, wherein a longitudinal groove (17) and a circular groove (16) within said pump body at said end bearing said sleeve, form a bypass about the inner bearing (5) for passage of gases found between the pump body (4) and the grooved dynamic molecular seal (8).

* * * * *